United States Patent [19]

Bonacci et al.

[11] 3,948,758

[45] Apr. 6, 1976

[54] PRODUCTION OF ALKYL AROMATIC HYDROCARBONS

[75] Inventors: John C. Bonacci, Cherry Hill; Ronald P. Billings, Clementon, both of N.J.

[73] Assignee: Mobil Oil Corporation, New York, N.Y.

[22] Filed: June 17, 1974

[21] Appl. No.: 479,930

[52] U.S. Cl. ..... 208/92; 208/62; 208/111; 260/668 A; 260/674 R

[51] Int. Cl.[2] ..... C10G 13/04

[58] Field of Search ..... 208/60, 92, 62, 66, 111; 260/672 R, 674 A, 672 T

[56] References Cited

UNITED STATES PATENTS

| | | | |
|---|---|---|---|
| 2,795,629 | 6/1957 | Boedeker | 260/672 R |
| 2,918,505 | 12/1959 | Scott et al. | 260/672 R |
| 3,037,930 | 6/1962 | Mason | 208/110 |
| 3,597,491 | 8/1971 | Kovach et al. | 260/672 R |
| 3,729,409 | 4/1973 | Chen | 208/135 |
| 3,767,568 | 10/1973 | Chen | 208/134 |
| 3,790,471 | 2/1974 | Argauer et al. | 208/111 |
| 3,804,746 | 4/1974 | Chu | 208/111 |
| 3,856,872 | 12/1974 | Morrison | 260/672 T |

*Primary Examiner*—Herbert Levine
*Attorney, Agent, or Firm*—C. A. Huggett

[57] ABSTRACT

Alkyl aromatic hydrocarbons useful as chemical raw material, solvents and the like are provided in high purity by hydrocracking of a fraction rich in alkyl aromatics and lean in aliphatic hydrocarbons over a particular zeolite catalyst associated with a hydrogenation/dehydrogenation component. The charge stock is characterized by substantial absence of hydrocarbons lighter than benzene. The technique is particularly well suited to production of maximum xylenes from a fraction containing higher boiling and lower boiling alkyl aromatics.

10 Claims, 2 Drawing Figures

PRODUCTION OF ALKYL AROMATIC HYDROCARBONS

BACKGROUND OF THE INVENTION

Alkyl aromatic compounds have long been produced from hydrocarbon fractions relatively rich in such materials. Early sources were liquids from coking or other distillation of coals. More recently, these products have been derived from fractions obtained in refining of petroleum and other fossil hydrocarbons such as shales and bitumens. An important source in recent years has been the aromatic liquid naphthas resultant from severe thermal cracking of gases and naphthas to produce olefins. A major present source is reformed naphtha prepared by processing a petroleum naphtha over a catalyst having an alumina base with one or more platinum group metals dispersed thereon, alone or in admixture with other metals such as rhenium.

However derived, these aromatic rich streams have usually been distilled or otherwise separated (e.g. solvent extraction) to obtain the desired product components. It has also been proposed to concentrate the aromatics by hydrocracking. See Mason U.S. Pat. No. 3,037,930. The purpose of these prior practices and of the present invention are well typified by a product of present major importance and techniques for providing the same at requisite high levels of purity. Reference is made to para-xylene, now used in huge quantities for manufacture of terephthalic acid to be reacted with polyols such as ethylene glycol to make polyesters.

The major raw material for p-xylene manufacture is catalytic reformate prepared by mixing vapor of a petroleum naphtha with hydrogen and contacting the mixture with a strong hydrogenation/dehydrogenation catalyst such as platinum on a moderately acidic support such as halogen treated alumina at temperatures favoring dehydrogenation of naphthalenes to aromatics, e.g. upwards of 850°F. A primary reaction is dehydrogenation of naphthenes (saturated ring compounds such as cyclohexane and alkyl substituted cyclohexanes) to the corresponding aromatic compounds. Further reactions include isomerization of substituted cyclopentanes to cyclohexanes, which are then dehydrogenated to aromatics, and dehydrocyclization of aliphatics to aromatics. Further concentration of aromatics is achieved, in very severe reforming, by hydrocracking of aliphatics to lower boiling compounds easily removed by distillation. The relative severity of reforming is conveniently measured by octane number of the reformed naphthas, a property roughly proportional to the extent of concentration of aromatics in the naphtha (by conversion of other compounds or cracking of other compounds to products lighter than naphtha).

To prepare chemical aromatics, a fraction of the reformate is prepared by distillation which contains six carbon atom and heavier ($C_6$+) compounds. That fraction is extracted with a solvent which is selective to either aromatics or aliphatics to separate the two types of compounds. This results in a mixture of aromatic compounds relatively free of aliphatics. Generally the fractionation preceding extraction is such that the fraction contains aromatics of six to eight carbon atoms, generally designated BTX for benzene, toluene, xylenes, although the fraction also contains ethyl benzene (EB).

Liquids from extremely severe thermal cracking, e.g. high temperature steam cracking of naphtha, are also rich in aromatics and may be used to prepare BTX in a manner analogous to that applied for reformate. Such liquids, sometimes called "pyrolysis gasoline" may be partially hydrogenated to convert diolefins or otherwise pretreated in the course of preparing BTX.

Concentrated aromatic fractions are also provided by severe cracking over such catalysts as ZSM–5 (Cattanach U.S. Pat. Nos. 3,756,942 and 3,760,024) and by conversion of methanol over ZSM–5.

From pure BTX, benzene and toluene are easily separated by distillation, leaving a $C_8$ fraction containing the desired p-xylene. A portion of the EB can be separated as such from the other $C_8$ aromatics, but the respective boiling points are such that substantially complete separation of EB requires "superfractionation" in elaborate, expensive distillation equipment requiring great operating expense. If EB is substantially completely removed, p-xylene may be recovered by fractional crystallization or selective sorption on solid porous sorbents. The remaining mixture of o-xylene and m-xylene is then subjected to isomerization and the isomerizate recycled to p-xylene separation with fresh charge. This constitutes a closed system herein called the "separation-isomerization loop" or simply the "loop". In some instances o-xylene is recovered by distillation and sold.

Processes are now available which will tolerate considerable amounts of EB in feed to the loop. This tolerance arises from use of an isomerization catalyst which will convert EB. "Octafining" is such a process now in wide use. It employs a catalyst of platinum on silica-alumina which concurrently isomerizes xylenes and converts EB in part to xylenes and in part to benzene and light products easily separated by distillation in the loop. Another proprietary process having similar effect is known as "Isomar". Certain crystalline aluminosilicate zeolites have been found to be effective for isomerization at specific conditions of xylenes which contain EB. These appear to act by disproportionation and dealkylation of EB to benzene and $C_9$+ alkyl aromatics (e.g. methyl ethyl benzene or diethyl benzene) also easily separable by distillation. Those techniques are described in copending applications Ser. Nos. 397,039 now U.S. Pat. No. 3,856,872, 397,195 now U.S. Pat. No. 3,856,874, 397,194 now U.S. Pat. No. 3,856,873, and 397,038 now U.S. Pat. No. 3,856,871, all filed September 13, 1973. The zeolites so applied are typified by the highly versatile material designated zeolite ZSM– 5 as described and claimed in U.S. Pat. Nos. 3,702,886 and 3,790,471.

Zeolite ZSM–5 has also been described as extraordinarily effective in processing of aromatic-containing materials in the nature of light and full range reformates. See U.S. Pat. Nos. 3,767,568 and 3,729,409. In that context, ZSM–5 acts to crack straight chain and singly branched paraffins of low octane number and alkylate aromatic rings with the cracked fragments. Although there are indications that new aromatic rings are generated, the principal effect is increased octane number by increasing the weight percent of high octane aromatic compounds in light reformate by increasing molecular weight of benzene and other low boiling aromatics.

It is here appropriate to note that zeolite beta has been reported as a catalyst for conversion of $C_9$ aromatics to $C_8$ aromatics. See U.K. Specification 1,343,172. This and other descriptions of using crystalline zeolites for processing alkyl aromatics to prepare chemical products (as contrasted with treating reformates for motor fuel) generally employ a restricted aromatic mixture as feed to the zeolite catalyzed process, except for the four copending applications cited above. For example, xylene isomerization with zeolites is usually demonstrated with a single xylene or mixture of xylenes, free of EB. Zeolites have been shown to be effective catalysts for isomerization, transalkylation (including disproportionation), alkylation and dealkylation of benzene and alkyl benzenes.

SUMMARY OF THE INVENTION

It has now been found that processing of heavy reformates, those from which benzene and lighter components have been largely removed by distillation or the like, over catalysts typified by zeolite ZSM-5 results in a conversion very different from that seen with light and full range reformates. In the substantial absence of benzene from the charge, there is a net decrease in total aromatics as contrasted with the net increase in aromatics when so processing the light reformates which contain benzene. That net decrease appears to be accomplished by decrease in average molecular weight of the aromatics. The number of rings remains essentially constant and the weight percent of the total attributable to side chains suffers a significant decrease, all as demonstrated by empirical data set out below.

Two components of the feed which have heretofore been handled at great expense are, by the present process, eliminated in a simple, fixed-bed catalytic reactor. The $C_6$+ aliphatic hydrocarbons in the raw feed are hydrocracked to low boiling hydrocarbons ($C_5$ and lighter) in the same vessel which adjusts concentration of alkyl aromatics. It is therefore unnecessary to subject the feed to a selective solvent extraction to separate aromatics from aliphatics, the most expensive single step in present commercial practice.

In addition, EB is selectively removed out of the $C_8$ fraction of the feed at the same time. This reduction in EB concentration is significant and occurs in part by dealkylation of the side chain, and in part by disproportionation to benzene and $C_9$+ alkyl benzenes such as ethyl toluene and diethyl benzene.

The invention is here described in detail as a means of processing heavy reformate from which benzene and lighter has been removed. It will be immediately apparent that source of the charge is immaterial and that the detailed description concerns the preferred charge (because presently available in quantity). Other charge stocks of similar composition from pyrolysis gasoline, Dripolene, processing of aliphatics or methanol over ZSM-5 and the like can be processed in the same fashion.

It will be seen that the invention provides a new approach to manufacture of aromatic chemicals. It will probably find most advantageous application in plants of design different from those common at the present time.

DESCRIPTION OF THE DRAWINGS

As shown in FIG. 1, the present invention can be applied in a plant for preparation of paraxylene from reformates without use of the EB column and solvent extraction commonly used in present commercial installations. It should be noted further that the zeolite reactor characteristic of the present invention could, if desired, discharge into the same separation train as that required for the isomerization loop, thus simplifying the flow sheet and reducing the capital investment required.

Figure 1:
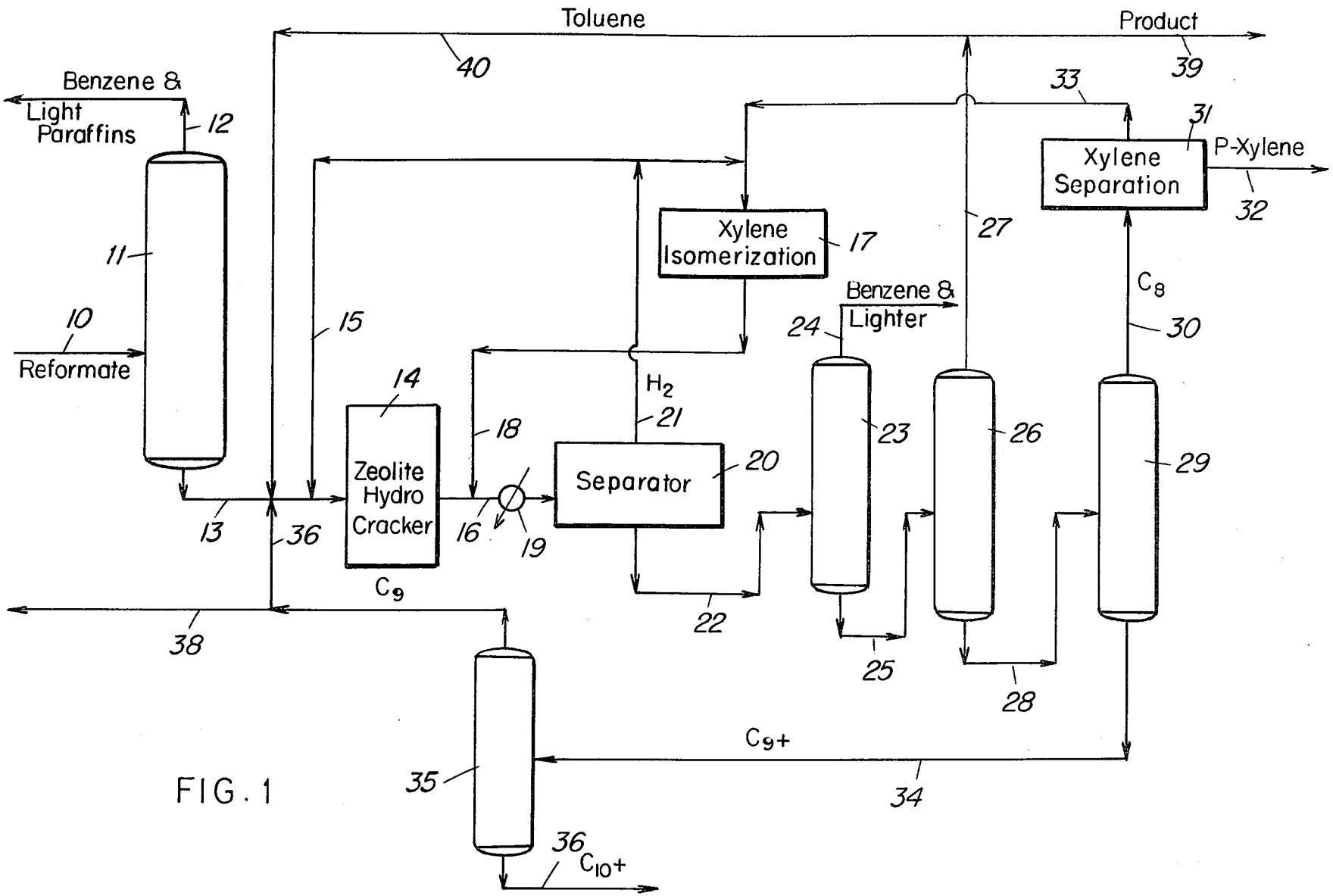
FIG. 1 of drawing annexed hereto is a diagrammatic representation of a plant for applying the invention according to the best mode now contemplated. It should be noted that the flow sheet lacks two expensive and troublesome units previously incorporated in plants for recovery of BTX or p-xylene from such charge stocks as reformate. There is no selective solvent extraction and there is no EB fractionator. The low EB level of the resulting material also makes separation of the desired p-xylene easier and more economic.

A suitable feed is supplied by line 10 to a fractionator 11 which supplies charge for the catalytic reactor. The fresh charge may be any hydrocarbon fraction rich in aromatics such as a reformate prepared by processing a petroleum naphtha over platinum on alumina reforming catalyst. Preferably the conditions of reforming are sufficiently severe that the reformate is very lean in parafinic hydrocarbons boiling in the range of the products desired from the completed process.

Fractionator 11 is operated to take the light paraffins overhead. Preferably the overhead stream at line 12 includes the major portion of the benzene in the charge and can include a substantial portion of the toluene. A satisfactory cut point between overhead and bottom is in the neighborhood of 230°F. In general, the resulting bottoms fraction should contain less than 15% non-aromatics.

The bottoms from column 11 are properly designated heavy reformate and are transferred by line 13 to a zeolite hydrocracker 14. Nature of the catalyst in the zeolite hydrocracker and conditions of operation are discussed hereinafter. The conversion occuring in zeolite hyrocracker 14 converts substantially all paraffins and other non-aromatic components to light products boiling in the range of benzene and below. To some extent there is rearrangement of alkyl aromatics by disproportionation and transalkylation. In addition, ethyl benzene is converted to products readily separated from the desired xylenes. The high EB conversion is by way of hydrocracking the ethyl side chain to leave benzene, by disproportionation to yield benzene and diethyl benzene, and by transalkylation of the ethyl group to make other $C_9$+ alkyl aromatics.

The reaction in the zeolite hydrocracker 14 is conducted under hydrogen pressure by addition of hydrogen from line 15 to be mixed with the heavy reformate before entering the reactor.

The effluent of reactor 14 is mingled in line 16 with a mixture of hydrogen and xylenes from xylene isomerization 17. The isomerizate is supplied by line 18 for admixture with the effluent of the reactor 14. The mixture of the two reactor effluents is cooled at heat exchanger 19 and passed to a high pressure separator 20 wherein hydrogen gas is separated from liquid hydrocarbons. The hydrogen gas passes by line 21 for recycle in the process and/or removal of light product gases while liquid hydrocarbons are transferred by line 22 to a benzene column 23 from which benzene and lighter materials pass overhead by line 24. The bottoms from column 23 pass by line 25 to a toluene column 26 from which toluene is taken overhead by line 27.

Bottoms from toluene column 26 pass by line 28 to s xylene column 29 from which the low ethyl benzene content $C_8$ fraction is taken overhead by line 30 to a xylene separation stage 31. The xylene separation may be of any type suitable fo separation of the desired xylenes. For example, paraxylene can be separated by fractional crystallization or by selective zeolite sorption to provide a p-xylene product stream withdrawn at line 32. The low EB level aids in ease of separation of p-xylene. The remaining $C_8$ aromatics are transferred by line 33 to xylene isomerization reactor 17 after admixture with hydrogen from line 21. The product of xylene isomerization passes by line 18 to complete the loop by being blended with the output of zeolite hydrocracker 14, as described.

Returning now to xylene column 29, the bottoms from this fractionator, constituted by $C_9$ and heavier aromatics, pass by line 34 to a splitter 35. $C_{10}$ and heavier aromatics are withdrawn as a bottoms stream from splitter 35 and transferred to product storage or further processing by line 36. The $C_{10}$+ aromatics are useful as heavy solvents, gasoline, and as source material for manufacture of lighter aromatic hydrocarbons.

As will be shown below, operation of the zeolite hydrocracker 14 is improved by adding toluene, $C_9$ aromatics or both to the charge for this reaction. Preferably the $C_9$ aromatics taken overhead from splitter 35 are recycled to the hydrocracker charge by line 37. A portion or all of the $C_9$ aromatics may pass to product storage or other processing by line 38. In similar fashion, the toluene taken overhead from column 26 may be passed to product storage or further processing by line 39. By preference, at least a portion of the toluene is recycled by line 40 to the charge for zeolite hydrocracker 14.

Figure 2:
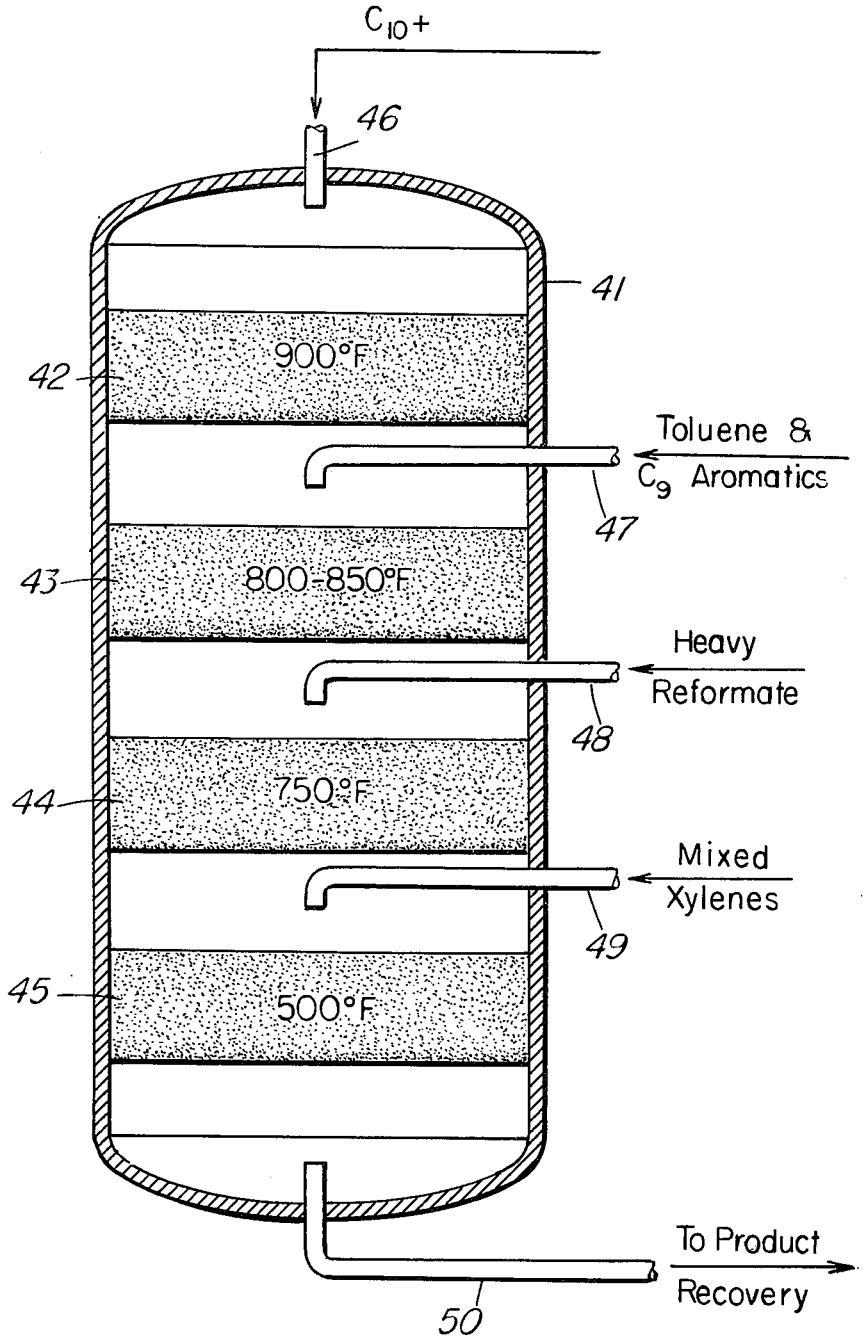
FIG. 2 is a sectional view in elevation of a combination reactor adapted to take advantage of some unique properties of the catalysts useful in practice of the invention.

The catalyst utilized in this operation is effective for other conversions of alkyl aromatics in the presence of hydrogen. A multibed reactor for handling different portions of the alkyl aromatic spectrum is shown in FIG. 2. This reactor, enclosed by a suitable pressure shell 41 is provided with four separate catalyst beds indicated respectively at 42, 43, 44 and 45. These catalysts may differ in composition but are preferably the catalysts hereinafter discussed for the conversion of heavy reformate and other hydrocarbon charges rich in aromatics.

At temperatures around 900°F., the catalyst will dealkylate heavy alkyl aromatics. Advantage is taken of this property by introducing $C_{10}$+ alkyl aromatics together with hydrogen by inlet 46 to pass downward through bed 42 which is maintained at 900°F. The effluent from bed 42 is constituted by lighter alkyl aromatics and light paraffins produced by cracking of side chains. This is admixed with toluene and $C_9$ aromatics entering at inlet 47 and passed through a bed of the catalyst maintained in the range of 800°–850°F. in bed 43. Transalkylation reactions occur in this bed to produce still more xylenes and the effluent is mixed with a charge such as heavy reformate admitted at 48 and passed through bed 44 maintained at about 750°F. to undergo the same type of reaction which takes place in zeolite hydrocracker 14 of FIG. 1.

A mixture of xylenes for isomerization is admitted at line 49 for admixture with the effluent of bed 44. The mixture passes through further bed 45 of the catalyst maintained at 500°F. for isomerization activity. The mixed reaction products are withdrawn by pipe 50 to pass through a product recovery train similar to that shown in xylene loop of FIG. 1. In effect, beds 44 and 45 constitute a combining of zeolite hydrocracker 14 and xylene isomerization reactor 17, shown separately in FIG. 1.

The catalyst employed in this invention is a crystalline aluminosilicate zeolite of high silica to alumina ratio, greater than 5 and preferably greater than 30. Operative catalysts include zeolite ZSM–5 type (including zeolite ZSM–11) and zeolites ZSM–12, ZSM–21 and beta.

Zeolite ZSM–5 and some of its unique properties in conversion of hydrocarbons are described in U.S. Pat. Nos. 3,702,886 and 3,790,421. Zeolite ZSM–11, here considered as a member of the group designated "ZSM–5 is described in U.S. Pat. No. 3,709,979. Zeolite ZSM–12 is described in U.S. Application Ser. No. 125,749 filed Mar. 18, 1971 now U.S. Pat. No. 3,832,449, the disclosure of which is hereby incorporated by reference.

Preparation of synthetic zeolite ZSM–21 is typically accomplished as follows: A first solution comprising 3.3 g. sodium aluminate (41.8% $Al_2O_3$, 31.6% $Na_2O$ and 24.9% $H_2O$), 87.0 g. $H_2O$ and 0.34 g. NaOH (50% solution with water) was prepared. The organic material pyrrolidine was added to the first solution in 18.2 g. quantity to form a second solution. Thereupon, 82.4 g. colloidal silica (29.5% $SiO_2$ and 70.5% $H_2O$) was added to the second solution and mixed until a homogeneous gel was formed. This gel was composed of the following components in mole ratios:

| | |
|---|---|
| $\frac{R^+}{R^+ + M'}$ | 0.87, wherein M is sodium and R is the pyrrolidine ion. |
| $\frac{OH^-}{SiO_2}$ | 0.094 (Not including any contribution of $OH^-$ from pyrrolidine) |
| $\frac{H_2O}{OH^-}$ | 210 (Not including any contribution of $OH^-$ from pyrrolidine) |
| $\frac{SiO_2}{Al_2O_3}$ | 30.0 |

The mixture was maintained at 276°C. for 17 days, during which time crystallization was complete. The product crystals were filtered out of solution and water washed for approximately 16 hours on a continuous wash line.

X-ray analysis of the crystalline product proved the crystals to have a diffraction pattern as shown in Table I.

TABLE I

| d (A) | I/Io |
|---|---|
| 9.5 ± 0.30 | Very Strong |
| 7.0 ± 0.20 | Medium |
| 6.6 ± 0.10 | Medium |
| 5.8 ± 0.10 | Weak |
| 4.95 ± 0.10 | Weak |
| 3.98 ± 0.07 | Strong |
| 3.80 ± 0.07 | Strong |
| 3.53 ± 0.06 | Very Strong |
| 3.47 ± 0.05 | Very Strong |
| 3.13 ± 0.05 | Weak |
| 2.92 ± 0.05 | Weak |

Chemical analysis of the crystalline product led to the following compositional figures:

| Composition | Wt. % | Mole Ratio on $Al_2O_3$ Basis |
|---|---|---|
| N | 1.87 | — |
| Na | 0.25 | — |
| $Al_2O_3$ | 5.15 | 1.0 |
| $SiO_2$ | 90.7 | 29.9 |
| $N_2O$ | — | 1.54 |
| $Na_2O$ | — | 0.11 |
| $H_2O$ | — | 9.90 |

Physical analysis of the crystalline product calcined 16 hours at 1000°F. showed it to have a surface area of 304 $m^2/g$ and adsorption tests produced the following results:

| Adsorption | Wt.% |
|---|---|
| Cyclohexane | 1.0 |
| n-Hexane | 5.4 |
| Water | 9.0 |

In determining the sorptive capacities, a weighed sample of zeolite was heated to 600°C. and held at that temperature until the evolution of basic nitrogeneous gases ceased. The zeolite was then cooled and the sorption test run at 12 mm for water and 20 mm for hydrocarbons.

Zeolite ZSM-21 is the subject of copending application Ser. No. 358,192, filed May 7, 1973 now abandonded.

Zeolite beta is described in U.S. Pat. No. 3,308,069.

These catalysts are characterized by unusually high stability and by exceptional selectivity in hydrocarbon reactions generally and in reactions of aromatic hydrocarbons particularly.

The particular zeolite catalyst selected is generally placed in a matrix to provide physically stable pellets. A suitable combination is 65 weight percent of the zeolite in 35 weight percent of a relatively inactive alumina matrix. The catalyst utilizes a hydrogenation component, preferably a metal of Group VIII of the Periodic Table.

The hydrogenation metal may be any of the several hydrogenation/dehydrogenation components known to the art. In selecting a hydrogenation metal, consideration must be given to the conditions of reaction contemplated. Thus, platinum may be employed if reaction temperatures above about 850°F. are to be used. At lower temperatures, the thermodynamic equilibrium tends to greater hydrogenation of the aromatic ring as the temperature is reduced. Since platinum is a powerful catalyst for hydrogenation, platinum will destroy aromatics at the lower temperatures. In general, considerably lower temperatures are desired for the present invention. Hence, a less active hydrogenation component is preferred. The preferred hydrogenation component is nickel. At the higher temperatures, the zeolites of extremely high silica/alumina ratio are preferred. For example, ZSM-5 of 3000 $SiO_2/Al_2O_3$ and upwards is very stable at high temperatures.

The metal may be incorporated with the catalyst in any desired manner, as by base exchange, impregnation etc. It is not essential that the nickel or other metal be in the zeolite crystallites themselves. However, the metal should be in close proximity to the zeolite portion and is preferably within the same composite pellet of zeolite and matrix. In any event, the zeolite should be exchanged to drastically reduce the alkali metal content, preferably well below 1 wt.%, either before, or after, or both, incorporation in a matrix. Many metals and non-metals are suitable, as is well known in the zeolite catalyst art.

A very satisfactory catalyst is constituted by 65 weight percent of NiH ZSM-5 composited with 35 weight percent of alumina matrix. This is prepared by base exchanging ZSM-5 with ammonia and with nickel acetate and calcining the zeolite before incorporation with the matrix. The particular catalyst used in obtaining the experimental data hereafter reported was of that nature. The final composite catalyst was in particles between 30 and 60 mesh and contained 0.68 weight percent nickel and 0.05 weight percent sodium. The particular ZSM-5 employed had a silica/alumina ratio of 70.

Reaction conditions under which the invention is conducted may vary with different charge stocks and with differences in desired slate of products. As pointed out above, the temperature selected should be related to the nature of the hydrogenation component and may range between about 500°F. and about 1000°F. The reaction is advantageously conducted at a pressure of about 100 to about 600 lbs. per square inch and a hydrogen to hydrocarbon mol ratio of 1 to 6. Space velocities can vary from about 0.5 unit weights of hydrocarbon charge per weight of zeolite catalyst (exclusive of matrix) per hour (WHSV) up to about 15 weight hourly space velocity. For convenience of measurement the experimental results reported below are given in terms of liquid hourly space velocity based on the volume of reactor filled by catalyst. It will be appreciated that liquid hourly space velocity is a good comparative measurement when using the same catalyst but can become relatively indefinite when the space velocity is related to active component in a composite catalyst of which the matrix component may vary widely, say from 20 to 95%.

In general, temperatures in the high part of the stated range tend to increase benzene yield by dealkylation of alkyl aromatics. The rate of reaction is increased by the higher temperatures permitting higher space velocity and better conversion of highly branched and large paraffin molecules. Since it is the purpose of the reaction to convert aliphatic compounds to low boiling materials easily separated, the temperature should be high enough to convert substantially all aliphatics, but low enough to avoid excessive dealkylation and disproportionation of desired alkyl aromatics. In general, it is preferred to operate at 700°F. with a nickel-acid zeolite.

At these preferred conditions there is little or no formation of aromatics having a propyl substituent. This characteristic of the present reaction conducted on heavy reformate is very different from the type of product yielded by processing of light and full range reformates as described in U.S. Pat. Nos. 3,757,568 and 3,729,409, cited above. This characteristic of the reaction is particularly important with respect to $C_9$+ materials intended for use as heavy solvents. When heavy solvents are produced by distillation and extraction from light reformates or from full range reformates processed over ZSM-5 they will contain substantial amounts of $C_3$ side chains. Side chains of that length are not found in appreciable quantities in heavy solvents produced according to this invention.

Since the destruction of heavy aliphatic compounds and the conversion of ethyl benzene processed by hydrocracking, it is essential that the reaction mixture include hydrogen. There should be enough hydrogen present in the reaction zone to suppress aging of the catalyst and to supply the chemical needs of hydrocracking.

A critical feature of the present invention is nature of the charge stock employed in order to obtain the results described generally above and shown below by experimental data. The input stream is a hydrocarbon fraction rich in aromatics and lean in non-aromatic components. It should contain no components below the boiling point of benzene and is preferably largely stripped of benzene. This critical charge stock is advantageously prepared by fractionation of an aromatic rich stock resulting in a heavy fraction containing less than 15 weight percent of aliphatic compounds. Typically, such stocks are derived by severe treatment of hydrocarbon charge materials, for example, severe reforming to convert substantially all naphthenes to aromatics, to dehydrocyclize a major portion of $C_6$+ aliphatic compounds and to hydrocrack a substantial portion of the remaining aliphatic compounds. A convenient yardstick of reforming severity is octane number of the gasoline boiling portion. In general, it is preferred to employ a product from reforming petroleum naphtha over platinum catalysts under conditions such that the $C_5$+ fraction of the reformate has a Research Octane Number, without alkyl lead antiknock additive (RON, clear) in excess of 90. Suitable stocks are also derived by severe steam cracking of naphthas and lighter hydrocarbons to make olefins. The liquid product of such severe thermal cracking may be partially hydrogenated to remove diolefins before fractionation to prepare charge stock for this invention.

Similarly, severe processing of light olefins and paraffins over catalysts such as ZSM–5 will produce aromatic rich streams. ZSM–5 is capable of converting such oxygenated compounds as alcohols and ethers to aromatic hydrocarbons under severe conditions of temperature and pressure.

The characteristic feature of charge stocks is not their source, but is rather the chemical makeup as described above.

EXAMPLE 1

A series of experiments were conducted over a catalyst that was 65 weight percent NiHZSM–5 described above in the form of 1/16 inch extrudate. Conditions other than temperature were maintained constant at 400 p.s.i.g. pressure, 2.5 LHSV and 2.0 $H_2$/HC, molar. The charge was the heavy end of a reformate (cut above 230°F.) from reforming of $C_6$–330°F. naphtha at 250 p.s.i.g. over a platinum on alumina catalyst at a severity to produce $C_5$+ having 103 Research Octane number with 3 cc's TEL. The results of runs at different temperatures are shown in Table II.

The distribution of $C_8$ aromatics in the feed and products is shown in Table III.

TABLE II

CONVERSION OF HEAVY REFORMATE TO AROMATIC FEEDSTOCK

| | CHARGE A | | | |
|---|---|---|---|---|
| | CHARGE | PRODUCT | | |
| Inlet Temperature, °F. | — | 600 | 700 | 800 |
| Composition, %Wt. Chg. | | | | |
| $H_2$ | — | −0.10 | −0.22 | −0.62 |
| $C_1$ | — | 0.01 | 0.08 | 0.84 |
| $C_2$ | — | 0.17 | 1.11 | 3.68 |
| $C_3$ | — | 1.71 | 3.64 | 5.84 |
| $C_4$'s | — | 1.02 | 1.29 | 0.95 |
| $C_5$'s | — | 0.48 | 0.49 | 0.15 |
| iso-Hexanes | 0.00 | 0.17 | 0.09 | 0.00 |
| n-Hexane | 0.00 | 0.04 | 0.01 | 0.00 |
| $C_6$ Napthenes | 0.00 | 0.03 | 0.00 | 0.00 |
| iso-Heptanes | 0.00 | 0.03 | 0.00 | 0.00 |
| n-Heptanes | 0.00 | 0.00 | 0.00 | 0.00 |
| $C_7$ Naphthenes | 0.00 | 0.02 | 0.00 | 0.00 |
| iso-Octanes | 1.87 | 0.80 | 0.16 | 0.02 |
| n-Octane | 0.60 | 0.00 | 0.00 | 0.00 |
| $C_8$ Naphthenes | 0.20 | 0.13 | 0.03 | 0.01 |
| $C_9$+ Non-Aromatics | 0.53 | 0.19 | 0.12 | 0.03 |
| Benzene | 0.00 | 2.60 | 5.30 | 8.60 |
| Toluene | 21.60 | 23.20 | 27.10 | 31.10 |
| Ethyl Benzene | 6.50 | 4.30 | 2.10 | 0.80 |
| Xylenes | 32.60 | 33.70 | 33.30 | 32.00 |
| $C_9$+ Aromatics | 36.10 | 31.50 | 25.40 | 16.60 |
| | 100.00 | 100.00 | 100.00 | 100.00 |
| Totals, % Wt. Chg. | | | | |
| BTX | 54.2 | 59.50 | 65.70 | 71.70 |
| Aromatic Rings | 70.0 | 70.00 | 70.20 | 69.60 |
| Aromatic Side Chains | 26.0 | 25.30 | 23.00 | 19.50 |
| $C_6$+ Non-Aromatics | 3.2 | 1.41 | 0.41 | 0.06 |
| $H_2$ Consumption, SCFB | — | 55 | 130 | 350 |

TABLE III

DISTRIBUTION OF C AROMATICS

| | CHARGE A | | | |
|---|---|---|---|---|
| | CHARGE | PRODUCT | | |
| Inlet Temperature, °F. | — | 600 | 700 | 800 |
| $C_8$ Isomer, Wt.% | | | | |
| Ethyl Benzene | 16.6 | 11.3 | 5.9 | 2.4 |
| p-Xylene | 19.9 | 22.0 | 23.2 | 23.6 |
| m-Xylene | 43.3 | 47.2 | 49.4 | 50.8 |
| o-Xylene | 20.2 | 19.5 | 21.5 | 23.2 |
| | 100.0 | 100.0 | 100.0 | 100.0 |

EXAMPLE 2

Further comparisons on processing heavy reformate over the same catalyst as in Example 1 are shown in Table IV. Conditions other than temperature were maintained at 425 p.s.i.g. pressure, 1.5 LHSV and 4.0 $H_2$/HC, molar. The charge was the heavy end of a reformate (cut above 230°F.) from reforming of $C_6$–265°F. naphtha at 250 p.s.i.g. over a platinum on alumina catalyst at a severity to produce $C_5$+ reformate having 100 Research Octane number with 3 cc's TEL.

The distribution of $C_8$ aromatics in the feed and products is shown in Table V.

TABLE IV

| CONVERSION OF HEAVY REFORMATE TO AROMATIC FEEDSTOCK CHARGE B | CHARGE | PRODUCT | | |
|---|---|---|---|---|
| Inlet Temperature, °F. | — | 650 | 700 | 750 |
| Composition, % Wt. Chg. | | | | |
| $H_2$ | — | −0.14 | −0.27 | −0.44 |
| $C_1$ | — | 0.07 | 0.17 | 0.41 |
| $C_2$ | — | 0.25 | 0.82 | 1.50 |
| $C_3$ | — | 3.30 | 5.40 | 5.86 |
| $C_4$'s | — | 2.14 | 2.41 | 2.04 |
| $C_5$'s | — | 1.04 | 0.97 | 0.68 |
| iso-Hexanes | 0.07 | 0.26 | 0.15 | 0.06 |
| n-Hexane | 0.05 | 0.02 | 0.01 | 0.00 |
| $C_6$ Naphthenes | 0.00 | 0.03 | 0.00 | 0.00 |
| iso-Heptanes | 0.21 | 0.05 | 0.03 | 0.00 |
| n-Heptane | 0.17 | 0.00 | 0.00 | 0.00 |
| $C_7$ Naphthenes | 0.13 | 0.09 | 0.07 | 0.05 |
| iso-Octane | 4.72 | 1.08 | 0.31 | 0.11 |
| n-Octane | 2.15 | 0.00 | 0.00 | 0.00 |
| $C_8$ Naphthenes | 0.50 | 0.19 | 0.13 | 0.07 |
| $C_9$+ Non-Aromatics | .80 | 0.22 | 0.10 | 0.06 |
| Benzene | 0.10 | 4.80 | 6.50 | 7.60 |
| Toluene | 29.90 | 28.10 | 31.40 | 33.00 |
| Ethyl Benzene | 8.70 | 2.50 | 1.50 | 1.00 |
| Xylene | 47.50 | 41.00 | 38.20 | 36.50 |
| $C_9$+ Aromatics | 5.00 | 15.00 | 12.10 | 11.50 |
| | 100.00 | 100.00 | 100.00 | 100.00 |
| Totals, % Wt. Chg. | | | | |
| BTX | 77.50 | 73.90 | 76.10 | 77.10 |
| Aromatic Rings | 70.00 | 70.00 | 70.00 | 70.40 |
| Aromatic Side Chains | 21.20 | 21.40 | 19.70 | 19.20 |
| $C_6$+ Non-Aromatics | 8.80 | 1.94 | 0.80 | 0.35 |
| $H_2$ Consumption, SCFB | — | 80 | 150 | 250 |

TABLE V

| DISTRIBUTION OF C AROMATICS CHARGE B | CHARGE, Wt.% | PRODUCT, Wt.% | | |
|---|---|---|---|---|
| Inlet Temperature, °F. | — | 650 | 700 | 750 |
| $C_8$ Isomer, Wt.% | | | | |
| Ethyl Benzene | 15.5 | 5.7 | 3.8 | 2.7 |
| p-Xylene | 20.1 | 23.2 | 23.7 | 23.7 |
| m-Xylene | 43.2 | 49.7 | 50.4 | 50.7 |
| o-Xylene | 21.2 | 21.4 | 22.1 | 22.9 |
| | 100.0 | 100.0 | 100.0 | 100.0 |

EXAMPLE 3

As pointed out above, the quantity of $C_9$+ aromatics in the feed has a dramatic effect on the operation. Comparative runs were made on charge stocks of different levels of $C_9$+ aromatics at 400 p.s.i.g. and 2.0 $H_2$/HC, molar. Other conditions of reaction are shown in Table VI which reports the results obtained.

TABLE VI

| EFFECT OF $C_9$+ AROMATICS | A | C | B |
|---|---|---|---|
| Charge | | | |
| Charge Composition, Wt.% | | | |
| $C_9$+ Aromatics | 36.1 | 15.0 | 5.0 |
| $C_6$+ Non-Aromatics | 3.2 | 6.6 | 8.8 |
| Process Conditions | | | |
| Average Temperature, °F. | 720 | 715 | 715 |
| LHSV, vol/vol/hr | 1.5 | 1.0 | 1.0 |
| Results | | | |
| $C_6$+ Non-Aromatics Conversion, Wt.% | 93.7 | 95.4 | 94.2 |

TABLE VI-continued

| EFFECT OF $C_9$+ AROMATICS | A | C | B |
|---|---|---|---|
| Charge | | | |
| Charge Composition, Wt.% | | | |
| Xylene Loss, Wt.% | 1.5 | 17.8 | 22.7 |

NOTE:
Charge A was the 230°F+ cut from product of platinum reforming a $C_6$-330°F naphtha. Charge B was a similar heavy cut from reforming a $C_6$-265°F naphtha. Charge C was a blend of A and B.

We claim:

1. An improved method for producing aromatic hydrocarbons from a hydrocarbon charge containing aromatic hydrocarbons including benzene and $C_8$ alkyl aromatics and aliphatic hydrocarbons which charge is rich in such aromatic hydrocarbons and lean in aliphatic hydrocarbons boiling above about 220°F. by reason of conversion under severe conditions which comprises subjecting said charge to distillation conditions of temperature and pressure such that at least a portion of the benzene content of said fraction is separated as vapor from a alkyl aromatic fraction containing aliphatic hydrocarbons and the major portion of $C_8$ aromatics in said charge, reacting said alkyl aromatic fraction in the presence of hydrogen in contact with a catalyst containing type ZSM–5 zeolite, Zeolite ZSM–12, zeolite ZSM–21 or zeolite beta in combination with a hydrogenation/dehydrogenation component at conversion conditions to convert aliphatic hydrocarbons to lower boiling material of five carbon atoms and lighter separable from aromatics by distillation including a temperature of about 500° to 1000°F., a pressure of about 100 to about 600 pounds, a hydrogen to hydrocarbon mol ratio of 1 to 6 and weight hourly space velocity of 0.5 to 15 and distilling the product of so reacting said fraction to separate therefrom desired aromatic hydrocarbons substantially free of aliphatics.

2. A process for manufacture of xylenes from a charge selected from the class consisting of reformate of at least 90 RON clear, pyrolysis gasoline and other hydrocarbon mixtures rich in aromatics and containing non-aromatics in an amount less than about 15 weight percent in the fraction thereof boiling above 220°F., which comprises:

a. fractionating the charge to take benzene overhead and recovering a liquid fraction containing the major portion of $C_8$ aromatics and heavier hydrocarbons of the charge in a fraction which contains less than 15 wt.% non-aromatic hydrocarbons;

b. reacting said liquid fraction in contact with a catalyst which contains a hydrogenation metal and a high silica crystalline aluminosilicate zeolite in the presence of hydrogen at conversion conditions to convert aliphatic hydrocarbons to lower boiling material of five carbon atoms and lighter separable from aromatics by distillation including a temperature of about 500° to about 1000°F., a pressure of about 100 to about 600 pounds, a hydrogen to hydrocarbon mol ratio of about 1 to about 6 and space velocity of about 0.5 to about 15 weights of hydrocarbon per weight of said zeolite per hour and distilling the product of so reacting said fraction to separate therefrom desired aromatic hydrocarbons substantially free of aliphatics.

3. A process for the manufacture of a xylene isomer by supplying a feed stream containing $C_8$ hydrocarbons to a process loop which includes the steps of separating a desired xylene isomer, subjecting the remaining hydrocarbons lean in desired isomer to catalytic isomerization which provides additional amounts of the desired isomer together with by-product hydrocarbons of lower and higher boiling point than $C_8$ aromatics, fractionating the isomerization effluent to remove said by-products of higher and lower boiling point and returning to said separation step the fraction of isomerization effluent from which by-products have been removed; the improvement which comprises fractionating a hydrocarbon charge rich in aromatics including benzene and $C_8$ alkyl aromatics and lean in non-aromatics boiling above about 220°F. to remove therefrom at least a substantial portion of the benzene content thereof together with lighter hydrocarbons and leave an aromatic fraction containing substantially all of the eight carbon atom aromatics of said charge, reacting said aromatic fraction in the presence of hydrogen by contact with a catalyst containing a hydrogenation component and a high silica crystalline aluminosilicate zeolite having at least a portion of its cations in the hydrogen form at conversion conditions to convert aliphatic hydrocarbons to lower boiling material of five carbon atoms and lighter separable from aromatics by distillation including a temperature of about 500 to about 1000°F., a pressure of about 100 to 600 pounds, a hydrogen to hydrocarbon mol ratio of about 1 to 6 and weight hourly space velocity with respect to said zeolite of about 0.5 to about 15, and mixing the hydrocarbon products of said reaction with the hydrocarbon effluent of said isomerization step whereby the said hydrocarbon products of said reaction and hydrocarbon effluent of said isomerization are fractionated together to provide recycle and fresh feed for said separation step.

4. The method of claim 1 wherein said hydrocarbon charge rich in aromatic hydrocarbons is a reformate prepared by severe reforming of a petroleum naphtha in admixture with hydrogen over platinum on alumina catalyst.

5. The method of claim 1 wherein the catalyst contacted with said alkyl aromatic fraction is the nickel and hydrogen form of zeolite ZSM–5.

6. The process of claim 2 wherein the catalyst of step (b) is the nickel and hydrogen form of zeolite ZSM–5.

7. The process of claim 3 wherein the hydrocarbon charge rich in aromatics is a reformate prepared by severe reforming of a petroleum naphtha in admixture with hydrogen over platinum on alumina catalyst.

8. The process of claim 3 wherein the high silica crystalline aluminosilicate zeolite is the hydrogen and nickel form of zeolite ZSM–5.

9. A process according to claim 2 wherein said conversion conditions are such as to produce toluene from aromatic components of said alkyl aromatic fraction and toluene is separated from said product of said contacting with catalyst, such separated toluene is admixed with said liquid fraction and the mixture is contacted with catalyst as aforesaid.

10. A process according to claim 2 wherein $C_9$+ aromatics are components of said alkyl aromatic fraction and $C_9$+ aromatics are separated from said product of said contacting with catalyst, such separated aromatics are admixed with said liquid fraction and the mixture is contacted with catalyst as aforesaid.

* * * * *

UNITED STATES PATENT AND TRADEMARK OFFICE

CERTIFICATE OF CORRECTION

PATENT NO. : 3,948,758

DATED : April 6, 1976

INVENTOR(S) : JOHN C. BONACCI and RONALD P. BILLINGS

It is certified that error appears in the above-identified patent and that said Letters Patent are hereby corrected as shown below:

| | |
|---|---|
| Column 5, line 4 | "s" should be --a--. |
| Column 9, line 2 | "processed" should be --proceed--. |
| Column 12, line 67 | "$C_8$ hydrocarbons" should be --$C_8$ aromatic hydrocarbons--. |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*